US005372656A

United States Patent [19]

Riesop

[11] Patent Number: 5,372,656

[45] Date of Patent: Dec. 13, 1994

[54] PROCESS FOR PRODUCING MANGANESE-CONTAINING ZINC PHOSPHATE COATINGS ON GALVANIZED STEEL

[75] Inventor: Joerg Riesop, Niederzier, Germany

[73] Assignee: Henkel Kommanditgesellschaft auf Aktien, Duesseldorf, Germany

[21] Appl. No.: 122,813

[22] Filed: Sep. 16, 1993

Related U.S. Application Data

[63] Continuation of Ser. No. 829,084, Feb. 18, 1992, abandoned.

[30] Foreign Application Priority Data

Aug. 17, 1989 [DE] Germany ..... 3927131

[51] Int. Cl.[5] ..... C23C 22/07

[52] U.S. Cl. ..... 148/262

[58] Field of Search ..... 148/262

[56] References Cited

U.S. PATENT DOCUMENTS 4,849,031 7/1989 Hauffe ..... 148/282

FOREIGN PATENT DOCUMENTS 227786 9/1988 Japan .

OTHER PUBLICATIONS

EP-0-106-459; European Pat. App. Apr. 25, 1984.
EP-0-228151 European Pat App. Jul. 8, 1987.

*Primary Examiner*—Sam Silverberg
*Attorney, Agent, or Firm*—Ernest G. Szoke; Wayne C. Jaeschke; Norvell E. Wisdom, Jr.

[57] ABSTRACT

In a process for phosphatizing electrolytically and/or hot-dip galvanized steel strip, the steel strip is briefly treated with acidic phosphatizing solutions which contain, in addition to zinc and phosphate ions, manganese and nickel cations and anions of oxygen-containing acids with an accelerator effect. The weight ratio of nickel cations to nitrate anions is adjusted to between 1:10 and 1:60 and the weight ratio of manganese cations nitrate anions is adjusted between 1:1 and 1:40.

20 Claims, No Drawings

PROCESS FOR PRODUCING MANGANESE-CONTAINING ZINC PHOSPHATE COATINGS ON GALVANIZED STEEL

CROSS-REFERENCE TO RELATED APPLICATION

This application is a continuation of copending application Ser. No. 07/829,084 filed Feb. 18, 1992, now abandoned.

BACKGROUND OF THE INVENTION

1. Field of the Invention

The present invention relates to a process for phosphating steel strip, which has been galvanized electrolytically and/or by melt immersion, in which process zinc phosphate layers containing manganese and nickel are formed. These zinc phosphate layers containing manganese and nickel are applied by spraying, spray-immersion and/or immersion with aqueous solutions.

2. Statement of Related Art

Processes for phosphating surfaces of iron, steel, zinc and the alloys thereof as well as of aluminum have long been state of the art (*Ullmanns Encyklopadie der technischen Chemie,* 4th Edition, Volume 15, Pages 686 and 687). Phosphating said surfaces serves to increase the adhesion strength of paint layers and to improve the protection from corrosion.

From W. A. Roland and K. -H. Gottwald, *Metalloberflache,* 42nd Year 1988/6 there have been known manganese-modified zinc phosphate coatings as adhesion primers for modern paint coatings. In this reference it is set forth that the use of manganese ions besides zinc and nickel ions in low-zinc phosphating processes, especially when using surface-modified thin sheets, demonstrably improves the anticorrosive property. The incorporation of manganese in the zinc phosphate coatings results in smaller and more compact crystals having an increased alkali resistance. At the same time the working range of phosphating baths is extended; aluminum also can be phosphated in a composite with steel and steel which has been galvanized electrolytically or by melt immersion to form a layer, with the generally achieved quality standard being ensured.

From DE 32 45 411 A1 there has been known a process for phosphating electrolytically galvanized metal goods, and especially galvanized steel strips, by short-term treatment with phosphating solutions which may contain, in addition to zinc and phosphate ions, further metal cations and/or anions of oxygen-containing acids having an accelerator effect. In these processes zinc phosphate layers having an areal density of less than 2 $g/m^2$ are formed. Acidic phosphating solutions, the content of $Zn2+$ cations of which is from about 1 to 2.5 g/l, are employed, while the free acid content is kept within the range of from 0.8 to 3 points, and the acid ratio of total acid to free acid is kept within the range of from 5 to 10. The duration of this treatment is not to be substantially more than 5 seconds.

It is preferred to work with nitrate-containing phosphating baths wherein the ratio by weight of $Zn^{+2}/NO_3^-$ is maintained within the range of from 1:1 to 1:8 and the ratio by weight of $PO_4^{-3}/NO_3^-$ is maintained within the range of from 1:0.1 to 1:2.5.

From EP 0 106 459 A1 there has been known a phosphating process wherein zinc phosphate coatings containing nickel and manganese are formed. The presence of fluoride ions is considered as being essential, and so is the upper concentration limit of 10 g/l of nitrate anions.

From EP 0 112 826 B1 there has been known a high-nickel phosphating process. Herein, a molar ratio of nickel to zinc within the range of from 5.2:1 to 16:1 is required.

Moreover, from EP 0 175 606 there has been known a phosphating process wherein, more particularly, the use of iron-containing phosphating baths is featured. Furthermore, a number of organic substances are used as accelerators, whereas the presence of manganese is not necessary. In addition, definite ratios of zinc to nickel and of zinc to iron are required.

The processes as presently used in practice for phosphating steel strip which has been galvanized electrolytically and/or by melt immersion are still subject to limitations, the elimination of which is desirable. Thus, In order to ensure a sufficient protection from corrosion, it is deemed to be required to form areal densities of the phosphate coatings of less than 2 $g/m^2$. An unsatisfactory to poor adhesion of subsequent coatings frequently is the result of a comparatively high areal density, more particularly if phosphated and coated material is deformed. In the processes utilized in practice, the duration of phosphating conventionally is more than 2 seconds, especially with strip velocities of about 60 to 120 m/min.

It has been known that, by a use of nickel cations in the phosphating solutions, improved values of adhesion and of protection from corrosion can be achieved. However, under this aspect it has been observed in the course of elaborating the present invention that an increase in the nickel concentration which results in an improvement of the anti-corrosive property at the same time causes a dark coloration of the zinc phosphate layer containing manganese and nickel.

DESCRIPTION OF THE INVENTION

Object of the Invention

Now, it was the object of the present invention, with treatment periods of from 2 to 30 seconds, to eliminate the occurrence of dark coloration of the zinc phosphate layers on steel strip which has been galvanized electrolytically and/or by melt immersion while retaining anticorrosive properties. At the same time, the nickel content of processes known from the literature was intended to be much reduced via a substitution by manganese, in order to achieve a protection from corrosion and an adhesion of the paint like that realized with the tri-cation processes employed in the automotive industry, also in the continuous phosphating of strip. In pursuing this goal it was of course indispensable that dense continuous layers of the phosphate coating are formed at said treatment periods and that the deformation properties are also satisfactory. Thereby the invention intentionally will put up with low coating masses of the phosphate layers, without thereby compromising the uniformity of the covering formed on the galvanized steel strip by a finely crystalline, strongly adhering continuous zinc phosphate layer. According to the invention, the term "steel strip, which has been galvanized electrolytically and/or by melt immersion" as used herein also includes zinc alloys as generally known (for example "Neuralyt" zinc alloy ZNE-electrolytically applied containing 10 to 13% of nickel, or "Galvannealed", zinc alloy ZFE-electrolytically applied, containing Fe). Herein, the term "zinc alloys" is generally intended to mean those zinc alloys containing at least 45% by weight of zinc.

SUMMARY OF THE INVENTION

The above-mentioned objects are attained by employing a process for phosphating steel strip, which has been galvanized electrolytically and/or by melt immersion, to form zinc phosphate layers containing manganese and nickel by means of a short-term treatment with acidic phosphating solutions, wherein the duration of the treatment is from 2 to 30 seconds, phosphating is carried out within a temperature range of from 40° C. to 70° C., and the phosphating solutions—at least in the beginning of the treatment—contain the following constituents or correspond to the following parameters, respectively:

Content of $Zn^{+2}$ cations: 0.02 to 0.75 g/l,
Content of $Mn^{+2}$ cations: 0.2 to 2.0 g/l,
Content of $Ni^{+2}$ cations: 0.1 to 2.0 g/l,
Content of $PO_4^{-3}$ anions: 10 to 20 g/l,
Content of $NO_3^-$ anions: 0.5 to 30 g/l,
Content of "free acid": within the range of from 1.6 to 3.0 points,
Content of "total acid": within the range of from 12 to 40 points.

In said process the ratio by weight of $Ni^{+2}$ cations to $NO_3^-$ anions is to be adjusted to within the range of from 1:10 to 1:60, and the ratio by weight of $Mn^{+2}$ cations to $NO_3^-$ anions is to be adjusted to within the range of from 1:1 to 1:40.

Within the scope of the invention, the content of $PO_4^{-3}$ anions as indicated above also includes the stoichiometric equivalent as $PO_4^{-3}$ anions of any $HPO_4^-$ anions, $H_2PO_4^-$ anions, and/or undissociated $H_3PO_4$ present in the phosphating solutions.

The definitions of the parameters mentioned herein as well as the determination thereof are described in detail in Chr. Ries, "Überwachung von Phosphatierungsbädern", *Galvanotechnik* 59, No. 1, pp. 37–39 (Eugen G. Leuze-Verlag, Saulgau, 1968). Thus, the number of points of free acid is defined as the number of milliliters of 0.1N NaOH required for the titration of 10 ml of the bath solution against dimethyl yellow, methyl orange or bromophenol blue. The number of points of total acid results as the number of milliliters of 0.1N NaOH required for the titration of 10 ml of the bath solution against phenolphthalein as indicator until the first occurrence of the pink color.

DESCRIPTION OF PREFERRED EMBODIMENTS

Accordingly, for the process according to the invention, the combination of all of the mentioned parameters is essential: The concentration of the $Zn^{+2}$ cations is maintained within a very low limited range. Low amounts of zinc ions are already initially added to the treatment bath in order to accelerate establishing the cation equilibrium. Zinc is known to be rapidly leached out from galvanized strip by the acidic phosphating solutions. If the zinc content of the phosphating solution prior to phosphating is in excess of 0.75 g/l, the adhesion of a subsequently applied paint may be diminished. Under certain conditions of the plant, in the course of the operation the zinc content in the phosphating bath will increase, due to the regular introduction of $Zn^{+2}$ cations by the galvanized steel strip, which increased zinc content, however, will not affect the process. Thereupon, in accordance with experience, a content of $Zn^{++}$ cations within the range of from 1.1 to 3 g/l, and preferably from 1.1 to 2.2 g/l, will be obtained.

If the content of manganese cations is less than 0.2 g/l, the manganese content in the zinc phosphate layer becomes so low that the adhesion between the substrate and the coating after cataphoretic painting is insufficient. If, on the other hand, the manganese content is in excess of 2.0 g/l, no further improvement of the effects can be achieved for the subsequent coating. However, at an elevated manganese concentration, precipitates will be deposited from the phosphating solution, so that it is impossible to provide a stable solution.

The simultaneous presence of nickel cations and manganese cations causes an extraordinarily good paint adhesion and extraordinarily good anticorrosive characteristics of the zinc phosphate coating after the application of the paint coating to be achieved.

If the content of phosphate anions in the solution is less than 10 g/l, a defective zinc phosphate layer is formed. If, on the other hand, the phosphate content exceeds 20 g/l, no additional advantageous effects can be obtained. Thus, the use of higher proportions of phosphate is disadvantageous for economic reasons.

Within the scope of the present invention, the phosphating solutions preferably do not contain any strong oxidants such as nitrites, chlorates, or hydrogen peroxide.

An essential constituent of the present invention is the ratio by weight of nickel cations to nitrate anions and the ratio by weight of manganese cations to nitrate anions. The simultaneous use of nickel and manganese cations is known to result in improved anti-corrosive characteristics, but also in dark coloration of the zinc phosphate layer in the processes known from the literature. Although said coloration does not play a dominant role in the automotive industry, the color shade of the zinc phosphate layer is of extraordinary importance in the production of household appliances, because in this case the paint layers to be subsequently applied often are very thin.

Another essential criterion of the present invention is the duration of the phosphating treatment. While in the automotive industry periods of time in excess of 120 seconds are conventionally employed, in phosphating galvanized steel strip it is desired in any case to employ a period of time of less than one minute. Thus, within the scope of the present invention, the duration of the treatment will be between 2 and 30 seconds. Particularly preferred is a duration of the treatment of from 3 to 20 seconds.

The essential advantage of the present invention is that, according to the invention, zinc phosphate coatings which have a bright surface appearance can be produced, even though the coatings contain nickel. At the same time, however, the nickel content could be distinctly reduced over that of prior art by substituting manganese, without any loss in the anti-corrosive characteristics. This is of ecological as well as of economical importance, as here for the first time a tri-cation process comprising manganese has been described for use in the strip sector.

In a preferred embodiment of the present invention, a process for phosphating steel strip, which has been galvanized electrolytically and/or by melt immersion, is characterized in that the phosphating solutions—at least in the beginning of the treatment—contain the following constituents or correspond to the following parameters, respectively:

Content of $Zn^{+2}$ cations: 0.4 to 0.6 g/l,
Content of $Mn^{+2}$ cations: 0.9 to 1.1 g/l,
Content of $Ni^{+2}$ cations: 0.6 to 0.9 g/l,
Content of $PO_4^{-3}$ anions: 12 to 16 g/l,
Content of $NO_3^-$ anions: 10 to 30 g/l.

A further preferred embodiment of the present invention consists in the fact that the ratio by weight of nickel cations to nitrate anions is adjusted to within the range of from 1:20 to 1:60. In the course of elaborating the present invention it was found that too high an amount of nitrate provides negative effects with respect to the phosphating process, as well as too low an amount of nickel does. Thereby, the anticorrosive characteristics are adversely affected. In a further preferred embodiment of the present invention, the ratio by weight of manganese cations to nitrate anions is adjusted to within the range of from 1:6 to 1:20. Hereby, more particularly, the wet adhesion of paint can be positively affected.

Of particular importance is the usability of the present process for phosphating steel strip, which has been galvanized electrolytically, as well as for phosphating steel strip, which has been galvanized by melt immersion. In practice, for electrolytically galvanized steel strip the presence of fluoride anions is not required, while the presence of fluoride does not interfere with the phosphating process. However, if a steel strip is employed, which has been galvanized by melt immersion, the use of fluoride ions is advised, especially if complexing of aluminum cations is required. Accordingly, a further preferred embodiment of the present invention is characterized in that the phosphating solutions comprise a content of fluoride anions of from 0.1 to 1.0 g/l, and preferably of from 0.4 to 0.6 g/l. The appropriate amount of fluoride anions is added to the phosphating solutions in the form of hydrofluoric acid or in the form of the sodium or potassium salts of said acid, respectively. Complex fluoride compounds such as fluoborates or fluosilicates may also be used in the place of the aforementioned compounds.

The actual phosphating operation is carried out at moderately elevated temperatures within the range of from about 40° C. to 70° C. The temperature range of from 55° C. to 65° C. may be especially suitable. Any technically usable method of applying the treatment solution is suitable. Thus, more specifically, it is possible to carry out the new process by means of the spray technique as well as by the immersion procedure.

Prior to the application of the phosphating solution, the surface which has been galvanized electrolytically and/or by melt immersion must be completely wettable by water. Regularly, this is the case with continuously operated strip units. If the surface of the galvanized has been oil-coated for the purposes of storage and protection from corrosion, the oil present will have to be removed prior to phosphating, by employing suitable means and methods as already known. Then the water-wettable galvanized metal surface is conveniently subjected to a per se known activating pre-treatment prior to the application of the phosphating solution. Suitable pre-treatment processes have been described, more particularly, in DE-OS 20 38 105 and DE-OS 20 43 085. In accordance therewith, the metal surfaces intended to be subsequently phosphated are treated with solutions which essentially contain, as the activating agents, titanium salts and sodium phosphate together with organic components such as, for example, alkyl phosphonates or polycarboxylic acids. As the titanium component, there may be preferably used soluble compounds of titanium such as potassium titanium fluoride and especially titanyl sulfate. Disodium orthophosphate is commonly used as the sodium phosphate. Titanium-containing compounds and sodium phosphate are employed in such ratios of amounts that the titanium content is at least 0.005% by weight, based on the weight of the titanium-containing compound and of the sodium phosphate.

As has been described in prior art—for example in DE-OS 32 45 411—it may be advantageous also for the process according to the invention and the zinc phosphate layers produced thereby, respectively, in a following process step to passivate the phosphate layers produced. Such a passivation, for example, may be effected with diluted chromic acid or mixtures of chromic and phosphoric acids. Therein the chromic acid concentration is generally between 0.01 and 1.0 g/l. A step of rinsing with water is employed between the phosphating and after-treating steps.

By means of the process according to the invention, there are produced zinc phosphate coatings having an areal density of the zinc phosphate layers of less than 2 $g/m^2$, said zinc phosphate layers having a continuous fine crystalline structure and imparting a desirable, uniform, light grey appearance to the steel strip, which has been galvanized electrolytically and/or by melt immersion. A steel strip which has been thus phosphated can also be further processed without any subsequent application of a paint or varnish. In many deformation processes, the thin phosphate layers produced by employing the process according to the present invention exhibit improved properties over those of the phosphate layers produced by means of conventional processes and have a higher areal density. But, in addition, organic coatings which have been applied afterwards exhibit a clearly improved adhesion over prior art, during as well as after the deformation processes.

In a further preferred embodiment of the present invention, if an electrolytically galvanized steel strip is employed, an areal density within the range of from 0.7 to 1.6 $g/m^2$ of the zinc phosphate layer is produced. If a steel strip is employed, which has been galvanized by melt immersion, the production of an areal density within the range of from 0.8 to 1.6 $g/m^2$ of the zinc phosphate layer is to be emphasized as being particularly advantageous.

The process according to the invention allows the application of the zinc phosphate layer containing manganese and nickel by means of techniques known in the art such as spraying, immersion and/or spray-immersion, and more specifically combinations of said techniques.

In a preferred embodiment of the invention, the acid ratio in the use of an electrolytically galvanized steel strip, i.e the quotient of "total acid" to "free acid", is adjusted to within the range of from 25:1 to 10:1, and preferably to within the range of from 15:1 to 10:1.

A further embodiment of the present invention is characterized in that the content of $NO_3^-$ anions in the phosphating solutions is from 1.0 to 30 g/l.

The surface layers produced by means of the process of the invention are well usable in any field where phosphate coatings are used. One case of a particularly advantageous application is in the preparation of the metal surfaces for painting, and particularly for electro-dip-coating.

EXAMPLES

In the course of the conventional process sequence comprising the steps of:

1. Cleaning and degreasing: Use of surfactant-containing alkaline cleaning agents (such as RIDOLINE® C 72) by spraying at from 50° C. to 60° C. and treatment periods of from 5 to 20 seconds.
2. Rinsing
3. Activating: Use of agents containing titanium salt (such as FIXODINE® 950) by spraying at from 20° C. to 40° C. and treatment periods of from 2 to 4 seconds.
4. Phosphating: Composition see Table 1.
5. Rinsing
6. After-passivation: Use of chromium-containing or chromium-free after-passivating agents (such as DEOXYLYTE® 41B or DEOXYLYTE® 80) by spraying or immersion at from 20° C. to 50° C. and treatment periods of from 2 to 6 seconds.
7. Squeegeeing: Supernatant liquid is removed without compaction of the layer by means of squeegee rollers.
8. Drying: The strip, after squeegeeing, is dried by means of its inherent heat.

the surface treatment was carried out with electrolytically galvanized steel (Zn layer thickness 7.5 μm on either side) and steel galvanized by melt immersion (Zn layer thickness 10 μm on either side).

Phosphate layers having an areal density of from 0.6 to 1.6 g/m$^2$ were produced on electrolytically galvanized steel (ZE), and, on steel galvanized by melt-immersion (Z) phosphate layers having an areal density of from 0.8 to 1.6 g/m$^2$ were produced.

The ions set forth in the following Table 1 were introduced into the phosphating solutions in the form of the following compounds:

Zn: as oxide or nitrate; Mn: as carbonate; Ni: as nitrate or phosphate; F: as hydrofluoric acid or sodium fluoride; PO4: as H3PO4 or nickel phosphate; NO3: as HNO3 or nickel nitrate.

For the preparation of the phosphating solutions, the above-mentioned compounds were dissolved in water in the amounts as reported for the respective ion species.

As the substrates to be phosphated, there were selected a steel electro-galvanized on both sides (7.5/7.5 μm of zinc) for examination by means of the VW Changing Climate Test P 1210 and a steel galvanized by melt immersion (10/10 μm of zinc) for the Salt Spray Test.

TABLE 1

| | Composition of Phosphating Baths | | | | |
|---|---|---|---|---|---|
| | Examples | | | | Comparative |
| Bath parameters | 1 | 2 | 3 | 4 | Example |
| FS[1] (Points) | 2.3 | 2.7 | 2.6 | 2.6 | 2.4 |
| GS[2] (Points) | 17 | 22 | 14 | 16 | 15 |
| $Zn^{+2}$ g/l | 0.5 | 0.5 | 0.5 | 0.5 | 0.9 |
| $Mn^{+2}$ g/l | 1.0 | 0.5 | 1.0 | 0.8 | 0.0 |
| $Ni^{+2}$ g/l | 0.6 | 0.2 | 0.8 | 0.6 | 0.2 |
| $F^-$ g/l | 0.1 | 0.0 | 0.1 | 0.1 | 0.0 |
| $PO_4^{-3}$ g/l | 13.0 | 13.0 | 16.0 | 14.0 | 13.0 |
| $NO_3^-$ g/l | 7.0 | 4.0 | 20.0 | 30.0 | 1.6 |
| Temp. °C. | 55 | 58 | 60 | 58 | 56 |
| Time s | 5 | 6 | 6 | 6 | 5 |

[1]FS = Free Acid
[2]GS = Total Acid

Typical layer analysis (quantitative analysis by atomic absorption spectroscopy, AAS) of the process on electrolytically galvanized steel:

| | Examples | | | | Comparative Example |
|---|---|---|---|---|---|
| Element | 1% | 2% | 3% | 4% | % |
| Manganese | 5.1 | 3.9 | 4.5 | 5.7 | 0.0 |
| Nickel | 0.6 | 0.2 | 0.8 | 0.4 | 0.1 |
| Zinc | 40.5 | 40.8 | 38.6 | 40.4 | 45.9 |
| Mass* | 1.0 | 1.1 | 0.9 | 1.0 | 1.2 |
| Surface | light grey | light grey | light grey | light grey | medium grey |

*Average areal density according to DIN 50942 in g/m$^2$.

With the sheets obtained by means of the Examples 1, 3 and 4 and the Comparative Example, corrosion tests in changing climate were carried out according to the VW Standard P 1210 over testing periods of 15 and 30 days and according to the salt spray test according to DIN 50 021 SS, 1008 hours.

As the paint coating for the test VW P 1210, the Standard KET Primer FT 85 7042, produced by BASF Lacke und Farben AG, was used, while for the salt spray test the Polyester Primer BASF Universal No. 21110, 4 μm, and the Unitecta Polyester Decklack No. 509 293 5002, 16 μm, were used.

| 1. VW Changing Climate Test P 1210 | | | | |
|---|---|---|---|---|
| | 15 Days | | | |
| | Example 1 | Example 3 | Example 4 | Comparative Example |
| Area according to DIN 53209 | m0/g0 | m0/g0 | m0/g0 | m0/g0 |
| Cut according to DIN 53167 in mm | 0.5 | 0.3 | 0.3 | 0.1 |
| Rockfall according to VW Standard | K2 | K2 | — | K5-6 |
| | 30 Days | | | |
| | Example 1 | Example 3 | Example 4 | Comparative Example |
| Area according to DIN 53209 | m0/g0 | m0/g0 | m0/g0 | m0/g0 |
| Cut according to DIN 53167 in mm | 1.1 | 0.6 | 0.8 | 1.7 |
| Rockfall according to VW Standard | K3 | K3 | K4 | K9 |

| 2. Salt Spray Test | | |
|---|---|---|
| | Example 1 | Example 3 |
| Area according to DIN 53209 | m0/g0 | m0/g0 |
| Cut according to DIN 53167 in mm | 2.2 | 0.0 |
| T-Bend Test[1] | 0 | 0 |

[1]T-Bend Test according to ECCA-T7 [1985].

In the determination of the degree of blistering of paint coatings according to DIN 53 209, any blister formation occurring in coatings is defined by indicating the degree of blistering. The degree of blistering, according to said Standard, is a measure for the blister formation by rating the frequency of blisters per unit area and the size of the blisters. The degree of blistering is denoted by a characteristic letter and a characteristic figure for the frequency of blisters per unit area and by a characteristic letter and a characteristic figure for the size of the blisters.

The characteristic letter and characteristic figure m0 means the absence of blisters, whereas m5 defines a certain frequency of blisters per unit area in accordance with the blister degree pictures according to DIN 53 209. The size of the blisters is indicated with the characteristic letter g and a characteristic figure within the range of from 0 to 5. The characteristic letter and characteristic figure g0 mean no blisters, whereas with g5 the size of the blisters corresponds to the blistering degree pictures given in DIN 53 209.

The degree of blistering is determined by comparison of the coating, the degree of blistering being that of the picture which is most similar to the appearance of the coating.

According to DIN 53 167 the salt spray mist test according to said Standard serves to determine the behavior of varnishes, paint coatings and other coatings under the action of sprayed sodium chloride solution. If the coating exhibits weak points, pores or lesions, then permeation through the coating (infiltration) will preferentially start from these locations. This leads to a reduction in or loss of adhesion and to corrosion of the metallic substrate.

The salt sprayed mist test is employed so that such defects can be recognized and infiltration can be detected.

Infiltration (undercutting), within the meaning of said Standard, is the permeation of sodium chloride solution at the boundary area between coating and substrate or at the boundary area between individual coatings starting from a place of lesion (crevice) produced in a defined manner or from existing weak points (e.g. pores, edges). The width of the zone of reduced or lost adhesion serves as the measure for the resistance of the coating on the respective substrate to sprayed sodium chloride solution.

The VW Standard P-VW 1210 represents a cyclic test consisting of a combination of various standardized testing procedures. Thus, in the present case, for the period of 15 days or 30 days a test cycle is maintained which consists of 4 hours of salt spray test according to DIN 50 021, 4 hours of rest period at room temperature, and 16 hours of condensation water constant conditions according to DIN 50 017.

In the beginning of the test, the test specimen is hit by a defined amount of steel shot of a definite particle size. After expiration of the testing period, a characteristic number is assigned to the degree of corrosion. For the characteristic numbers of from 1 to 10, the characteristic number 1 denotes no visible corrosion, whereas at a characteristic number of 10 virtually the whole surface has been corroded.

In the T-Bend Test, the test sheet is bent with varying bending radii in parallel to the rolling direction by 180° within from 1 to 2 seconds, the coating being on the external surface. The smallest bending radius that allows the sample to be bent without any peel-off of the coating determines the adhesion strength at an 180 ° bend. In the test TO, the sheet without an intermediate layer is uniformly bent by 180° within from 1 to 2 seconds. Immediately after having been bent, the sheet is examined with a 10-power magnifying lens. An aggravation of the testing method consists of firmly pressing an adhesive tape onto one edge and then quickly tearing it off. Then the amount of coating removed is evaluated.

What is claimed is:

1. A process for phosphating a steel strip, which has been galvanized electrolytically, by melt immersion, or both electrolytically and by melt immersion, to form thereon zinc phosphate layers containing manganese and nickel, said layers having an areal density of less than 2 g/m$^2$, by treatment with acidic phosphating solutions containing $Zn^{+2}$, $Mn^{+2}$, $Ni^{+2}$, $PO_4^{-3}$ and $NO_3^-$ ions, wherein:

the duration of the treatment is from 3 to 20 seconds, the phosphating is carded out within a temperature range of from 40° C. to 70° C., and the phosphating solutions, at least in the beginning of the treatment, consist essentially of:

0.02 to 0.75 g/l of $Zn^{+2}$ cations;

0.9 to 1.1 g/l of $Mn^{+2}$ cations;

0.6 to 0.9 g/l of $Ni^{+2}$ cations;

12 to 16 g/l of $PO_4^{-3}$ anions;

10 to 30 g/l of $NO_3^-$ anions;

1.6 to 3.0 points of "free acid"; and 12 to 40 points of "total acid"

and wherein:

the ratio by weight of $Ni^{+2}$ cations to $NO_3^-$ anions is adjusted to within the range of from 1:10 to 1:60, and the ratio by weight of $Mn^{+2}$ cations to $NO_3^-$ anions is adjusted to within the range of from 1:1 to 1:40.

2. A process according to claim 1, wherein the ratio by weight of $Ni^{+2}$ cations to $NO_3^-$ anions is adjusted to within the range of from 1:20 to 1:60.

3. A process according to claim 1, wherein the ratio by weight of $Mn^{+2}$ cations to $NO_3^-$ anions is adjusted to within the range of from 1:6 to 1:20.

4. A process according to claim 1, wherein the phosphating solutions comprise a content of $F^-$ anions of from 0.1 to 1.0 g/l.

5. A process according to claim 4, wherein the phosphating solutions comprise a content of $F^-$ anions of from 0.4 to 0.6 g/l.

6. A process according to claim 1, wherein the phosphating operation is carried out within the temperature range of from 55° C. to 65° C.

7. A process according to claim 1, wherein the areal density of the zinc phosphate layers is within the range of from 0.7 to 1.6 g/m$^2$ and an electrolytically galvanized steel strip is employed.

8. A process according to claim 1, wherein the areal density of the zinc phosphate layers is within the range of from 0.7 to 1.6 g/m$^2$, and a steel strip that has been galvanized by melt immersion is employed.

9. A process according to claim 1, wherein the steel strip in advance has been subjected to an activation pre-treatment.

10. A process according to claim 1, wherein a steel strip which has been electrolytically galvanized is used and the acid ratio is adjusted to be within the range of from 25:1 to 10:1.

11. A process according to claim 10, wherein the acid ratio is adjusted to be within the range of from 15:1 to 10:1.

12. A process according to claim 11, wherein the steel strip in advance has been subjected to an activation pre-treatment using titanium-containing activating solutions.

13. A process according to claim 8, wherein the steel strip in advance has been subjected to an activation pre-treatment using titanium-containing activating solutions.

14. A process according to claim 7, wherein the steel strip in advance has been subjected to an activation pre-treatment using titanium-containing activating solutions.

15. A process according to claim 6, wherein the steel strip in advance has been subjected to an activation pre-treatment using titanium-containing activating solutions.

16. A process according to claim 5, wherein the steel strip in advance has been subjected to an activation pre-treatment using titanium-containing activating solutions.

17. A process according to claim 4, wherein the steel strip in advance has been subjected to an activation pre-treatment using titanium-containing activating solutions.

18. A process according to claim 3, wherein the steel strip in advance has been subjected to an activation pre-treatment using titanium-containing activating solutions.

19. A process according to claim 2, wherein the steel strip in advance has been subjected to an activation pre-treatment using titanium-containing activating solutions.

20. A process according to claim 1, wherein the steel strip in advance has been subjected to an activation pre-treatment using titanium-containing activating solutions.

* * * * *

UNITED STATES PATENT AND TRADEMARK OFFICE

CERTIFICATE OF CORRECTION

PATENT NO. : 5,372,656

DATED : Dec. 13, 1994

INVENTOR(S) : Riesop

It is certified that error appears in the above-indentified patent and that said Letters Patent is hereby corrected as shown below:

In claim 2, column 10, line 30, after "1:60", insert:
-- and the phosphating solutions, at least in the beginning of the treatment, contain 0.4 to 0.6 g/l of $Zn^{+2}$ cations --.

Signed and Sealed this

Eleventh Day of July, 1995

*Attest:*

Bruce Lehman

BRUCE LEHMAN

*Attesting Officer*

*Commissioner of Patents and Trademarks*